US005102298A

United States Patent [19]

Kreitmeier

[11] Patent Number: 5,102,298

[45] Date of Patent: Apr. 7, 1992

[54] AXIAL FLOW TURBINE

[75] Inventor: Franz Kreitmeier, Baden, Switzerland

[73] Assignee: Asea Brown Boveri Ltd., Baden, Switzerland

[21] Appl. No.: 571,153

[22] Filed: Aug. 23, 1990

[30] Foreign Application Priority Data

Sep. 12, 1989 [CH] Switzerland ..... 3322/89

[51] Int. Cl.[5] ..... F01D 7/00; F01D 9/04; F01D 25/30

[52] U.S. Cl. ..... 415/211.2; 415/148

[58] Field of Search ..... 415/208.1, 208.2, 208.3, 415/208.4, 209.1, 211.1, 211.2, 220, 191, 192, 193, 181, 182.1, 149.2

[56] References Cited

U.S. PATENT DOCUMENTS

| | | | |
|---|---|---|---|
| 2,674,845 | 4/1954 | Pouchot | 415/209 |
| 2,682,363 | 6/1954 | Lombard et al. | 415/208.2 |
| 2,815,770 | 12/1957 | Thorp, II | 415/182.1 |
| 3,447,741 | 6/1969 | Havette et al. | 415/191 |
| 3,652,184 | 3/1972 | Conrad | 415/208.2 |
| 4,116,584 | 9/1978 | Bammert et al. | 415/208.1 |
| 4,398,865 | 8/1983 | Garkusha et al. . | |
| 4,802,821 | 2/1989 | Kreitmeier | 415/208.2 |
| 4,950,129 | 8/1990 | Patel et al. | 415/148 |
| 4,995,786 | 2/1991 | Wheeler et al. | 415/148 |

FOREIGN PATENT DOCUMENTS

| | | |
|---|---|---|
| 0265633 | 5/1988 | European Pat. Off. . |
| 2047820 | 12/1980 | United Kingdom . |

*Primary Examiner*—Edward K. Look
*Assistant Examiner*—Michael S. Lee
*Attorney, Agent, or Firm*—Oblon, Spivak, McClelland, Maier & Neustadt

[57] ABSTRACT

An axial flow turbine, whose outlet rotor blades (12) are followed by a diffuser (13), has first means (8) within the retardation zone of the diffuser for swirl removal from the swirling flow.

A row with adjustable guide vanes (11) is arranged between these first means for swirl removal in the form of aerodynamic ribs and the outlet rotor blades. These guide vanes (11) have a straight mean camber line with a symmetrical aerofoil section, are conically shaped in the radial direction and are twisted.

In addition to a substantial improvement in the pressure recovery over a wide load range, this measure also permits the vortex usually occurring between the rotor blades and the aerodynamic ribs to be prevented.

9 Claims, 3 Drawing Sheets

AXIAL FLOW TURBINE

BACKGROUND OF THE INVENTION

1. Field of the Invention

The invention concerns an axial flow turbine whose outlet rotor blades are followed by a diffuser, means for swirl removal from the swirling flow being provided within the retardation zone of the diffuser.

2. Discussion of Background

Such a turbine is known from EP-A 265 633. In order to meet the requirement of this patent for the best possible pressure recovery at part load, a straightening cascade is provided within the diffuser and this extends over the complete height of the flow duct. These means for removing swirl involve three aerodynamic ribs with thick aerofoil sections arranged evenly around the periphery. These aerofoil sections are designed from knowledge of turbomachinery and should be as insensitive as possible to oblique incident flow. The rib leading edges subject to incident flow are located relatively far behind the outlet edge of the last rotor blades in order to avoid excitation of the last row of blades due to the pressure field of the ribs. This distance is dimensioned in such a way that the leading edge of the ribs is located in a plane at which there is a diffuser area ratio of, preferably, three. The diffuser zone between the blading and the aerodynamic ribs should therefore remain undisturbed because of total rotational symmetry. The fact that no interference effects between the ribs and the blading are to be expected may be attributed to the fact that the ribs only become effective in a plane in which there is already a relatively low energy level.

In conventional gas turbines, the diffuser is subject to incident flow at a velocity ratio $c_t/c_n$ of about 1.2 at idle, $c_t$ being the tangential velocity and $c_n$ being the axial velocity of the medium. This oblique incident flow leads to a reduction in the pressure recovery $C_p$, as may be seen from FIG. 2, to be described later (curve A).

In other types of machine, such as for example steam turbines or gas turbines for fluidized bed firing, it is quite possible for the volume flow to be reduced to 40% so that $c_t/c_n$ ratios of up to 3 occur. In such types of machines, the known diffuser configuration is not appropriate because the pressure recovery could even become negative, as may be seen in FIG. 2. This applies even in the case where the pitch/chord ratio of the aerodynamic ribs is 0.5 (curve A). Aerodynamic ribs with pitch/chord ratios of about 1 (curve B) cannot be used at all in such machines—even though they would give a somewhat larger pressure recovery at full load, i.e. at a $c_t/c_n$ of about zero (see FIG. 2).

In addition to the large drop in pressure recovery, a strong vortex between the outlet rotor blades and the aerodynamic ribs is a characteristic feature under the extreme conditions mentioned. This is indicated in FIG. 1, which is also described later. The vortex is limited by the aerodynamic ribs on which the tangential component of the velocity is dissipated. If solid particles, in gas turbines for example, or water droplets, in steam turbines for example, are entrained in the resulting reverse flow, there may be acute danger of root erosion on the blades of the last rotor row.

In the case of gas turbines for fluidized bed firing, the pressure behind the blading, generally 0.98 bar at full load, can rise as high as 1.15 bar at 40% volume flow. This back pressure means that at 40% volume flow, significantly more drive power has to be provided for the machine than would be necessary in the presence of a satisfactorily operating diffuser.

SUMMARY OF THE INVENTION

Accordingly, one object of this invention is to design the diffusion zone in axial flow turbines of the type mentioned at the beginning in such a way that the part-load behavior of the machine is further improved.

This is achieved, in accordance with the invention, by arranging at least one row of adjustable guide vanes between the means for swirl removal and the outlet rotor blades.

The advantage of the invention may be seen, inter alia, in that—in addition to the substantially improved pressure recovery over a wide range of load—the swirl mentioned above, insofar as it still appears at all, also only forms between the guide vanes and the aerodynamic ribs and cannot, therefore, have any detrimental effect on the rotating outlet blades.

It is particularly useful for the guide vanes to have a straight mean camber line with a symmetrical aerofoil section. By means of this measure, the sufficiently known properties of such cascades with respect to incident flow insensitivity can be used for low-loss deflection.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
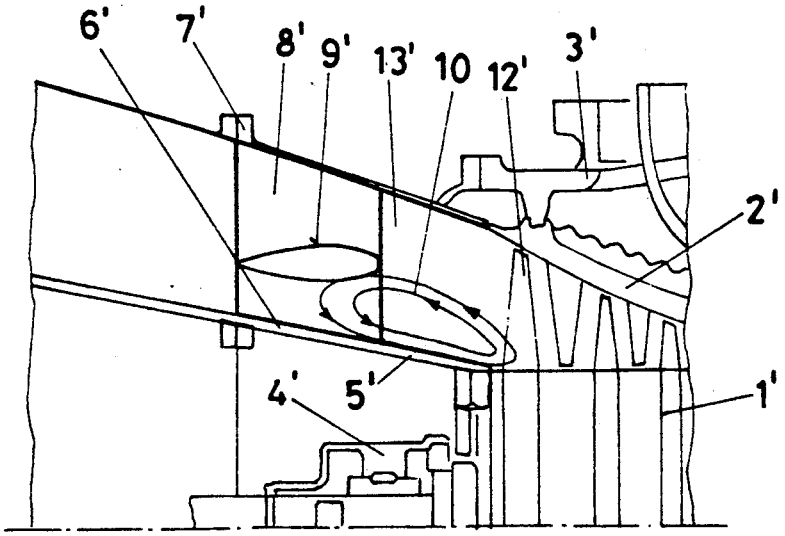
FIG. 1 shows a diagrammatic sketch of the principle of a diffuser system associated with the present state of the art.

Referring now to the drawings, wherein like reference numerals designate identical or corresponding parts throughout the several views, wherein only those elements essential to understanding the invention are shown, wherein, for example, the compressor part, the combustion chamber and the complete exhaust gas duct and the chimney are not shown and wherein, furthermore, the flow direction of the working medium is indicated by arrows, the known gas turbine, of which only the three last, axial-flow stages are shown in FIG. 1, consists essentially of the bladed rotor 1' and the vane carrier 2' fitted with guide vanes. The vane carrier is secured in the turbine casing 3'. The rotor is located in a support bearing 4' which is in turn supported in an exhaust gas casing 5'. This exhaust gas casing 5' consists essentially of an inner part 6' at the hub and an outer part 7', which parts form the boundaries of the diffuser 13'. Both elements 6' and 7' can be one-piece barrel-type casings without axial split planes. They are connected together by a plurality of welded-on load-bearing aerodynamic ribs 8', which are evenly distributed around the periphery and whose aerofoil section is indicated by 9'. It may be seen that for the reasons mentioned at the beginning, the aerodynamic ribs 8' are arranged at due distance from the blading.

The strong vortex 10 which forms at lower part load between the outlet rotor blades 12' and the aerodynamic ribs 8', and which the invention is intended to avoid, can also be seen.

Figure 2:
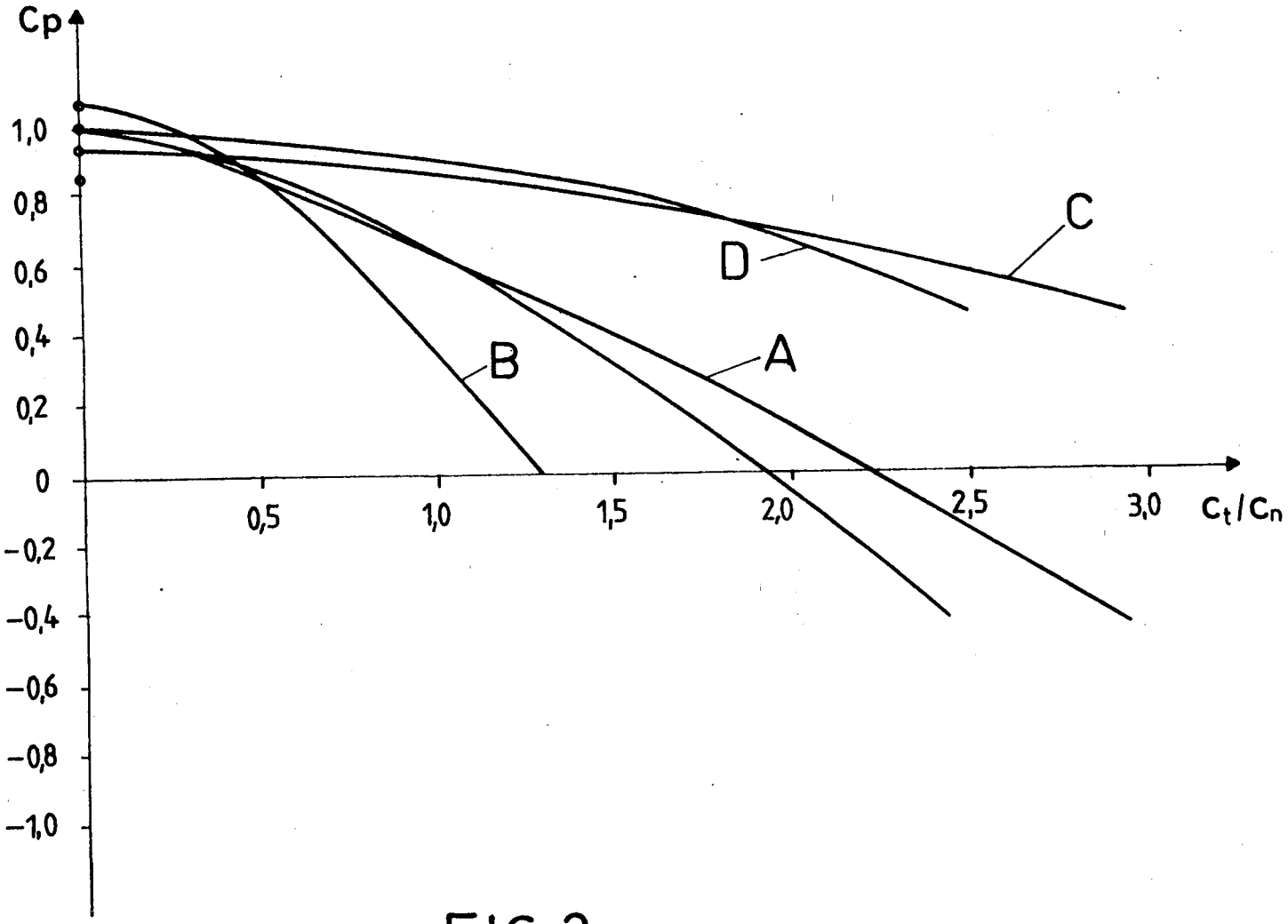
FIG. 2 shows a pressure recovery diagram as a function of $c_t/c_n$.

The result of such a vortex can be shown by means of the diagram in FIG. 2. All the absolute values based on calculations and tests are not, of course, made known. These would not, in any case, be sufficiently conclusive because they depend on parameters which are all too numerous. The curves presented have, in consequence, to be laid out qualitatively in the main. The value $c_t/c_n$ is plotted on the abscissa of the diagram and this represents a measure of the volume flow. It is the tangent of the outlet angle $\alpha$ from the last outlet rotor blades, $c_t$ being the tangential component and $c_n$ being the normal component. At constant machine rotational speed, this angle becomes continually larger with decreasing load (and hence decreasing volume flow).

The pressure recovery $C_p$ is plotted on the ordinate. This corresponds, as a first approximation, to the ratio $(p_A-p_E)/(p^*_E-p_E)$, where $p_A$ is the static pressure at the outlet from the diffuser, $p_E$ is the static pressure at the inlet to the diffuser and $p^*_E$ is the total pressure at the inlet to the diffuser —and hence at the outlet from the blading.

Curve A shows the pressure recovery in a diffuser which is equipped with aerodynamic ribs having a pitch/chord ratio of about 0.5. It may be seen that the drop is fairly tolerable up to a $c_t/c_n$ value of one but that the pressure recovery deteriorates dramatically when the volume flow becomes smaller. Curve B shows the completely unacceptable variation when aerodynamic ribs with a pitch/chord ratio of about 1 are used.

Figure 3:
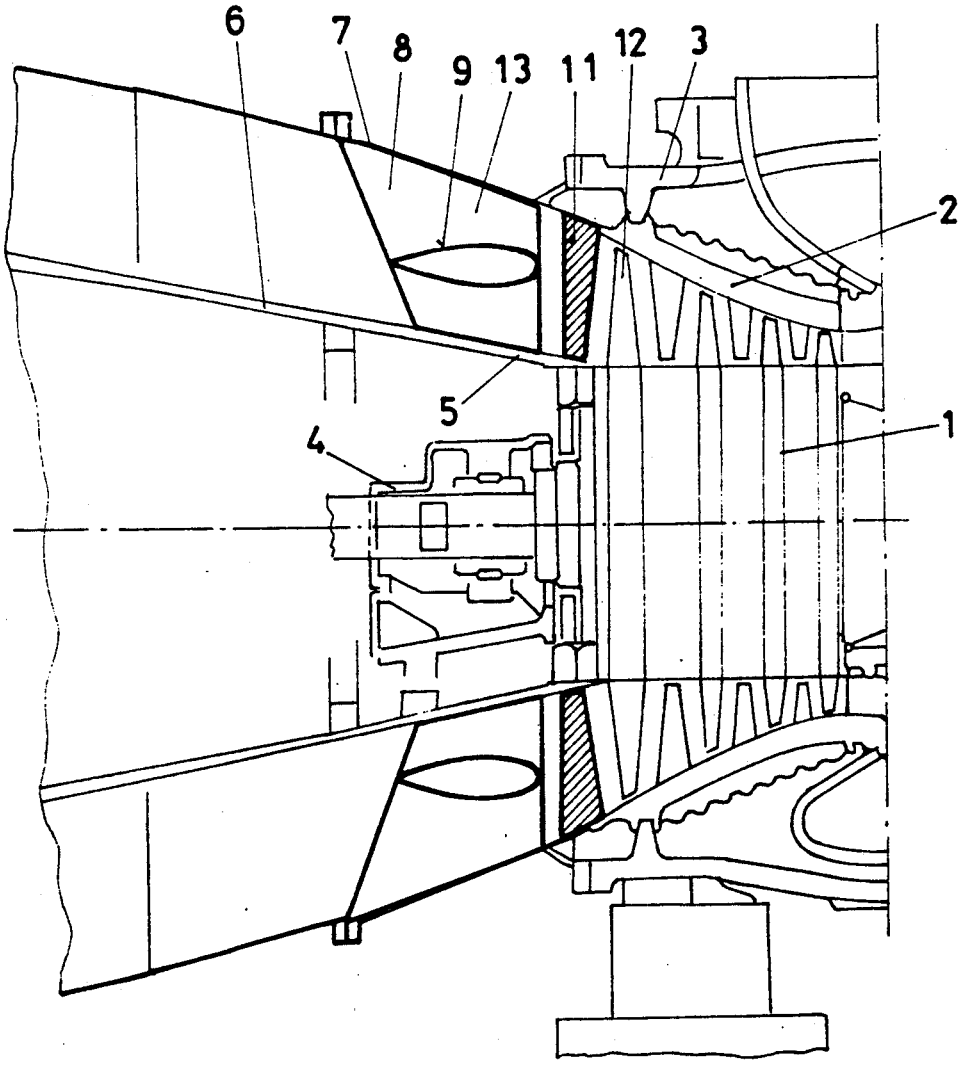
FIG. 3 shows a partial longitudinal section through a gas turbine with a diffuser in accordance with the invention.

In order to alleviate this position, a row of adjustable guide vanes is now arranged, in accordance with the invention, between the outlet rotor blades 12 and the aerodynamic ribs 8, as may be seen in FIG. 3. The structure of the gas turbine shown in that figure corresponds to the one in FIG. 1 and for this reason, a further description of the construction is omitted. The same elements as in FIG. 1 are shown in FIG. 3 with the same reference signs without (′). Straightening aerodynamic ribs 8 with a straight mean camber line and a pitch/chord ratio of 0.5 are evenly distributed around the periphery. This ratio occurs in the center section of the flow duct of the aerodynamic ribs, which are conically shaped in the radial direction.

The guide vanes 11 also have a symmetrical aerofoil section with a straight mean camber line, as known, for example, under the designation NACA 0010. In the present case, these guide vanes have a pitch/chord ratio of 0.5 in the center section of the flow duct. Such vanes are, to a certain extent, insensitive to oblique incident flow (see article by N Scholz "Untersuchungen an Schaufelgittern von Strömungsmaschinen", Zeitschrift für Flugwissen-schaften, No. 3, 1955) (Studies on cascades of flow machines). The guide vanes 11 are conically shaped in the radial direction and are preferably twisted.

The adjustment of the guide vanes 11 in the cascade takes place by means of actuating means, not shown, such as are known for example from compressor construction. The actual adjustment preferably takes place automatically as a function of operating parameters such as load, rotational speed, etc. The maximum pressure recovery is obtained when the adjustment of the guide vanes takes place in such a way that the shaft power assumes the maximum possible value under all operating conditions. A permanent power measurement is therefore suitable. The maximum pressure recovery can also be achieved when the adjustment of the guide vanes takes place in such a way that the static pressure before the guide vanes 11, i.e. behind the outlet rotor blades 12, assumes the lowest possible value. A permanent differential pressure measurement $p_A-p_E$ is therefore suitable.

Figure 4:
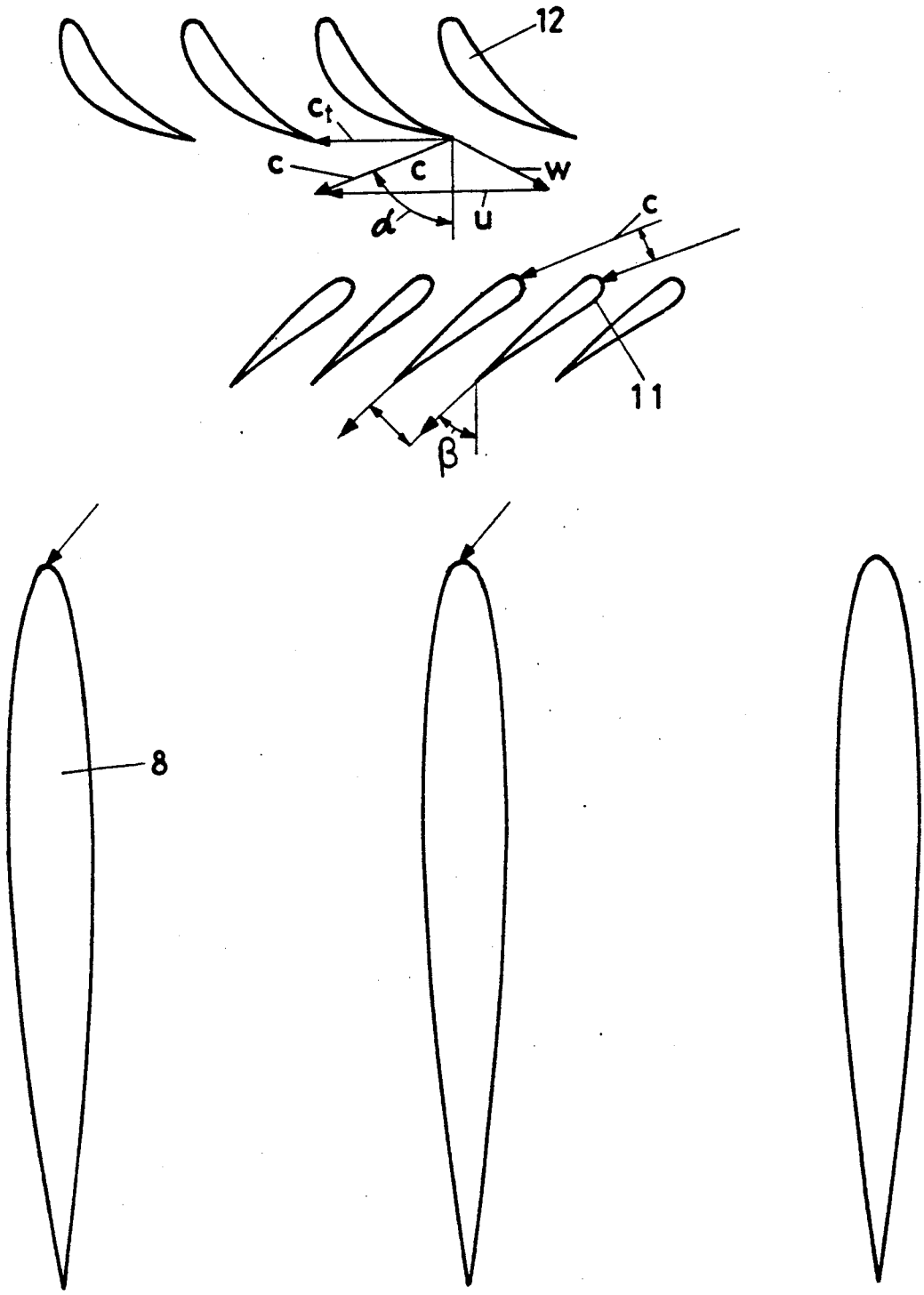
FIG. 4 shows the partial development of a cylindrical section at the average diameter of the flow duct of FIG. 3.

The cylindrical section in FIG. 4 shows, to an enlarged scale, the blading diagram in the gas turbine zone considered. In this diagram, the symbol c represents the absolute velocity in each case, w represents the relative velocity and u the peripheral velocity of the machine. In order to provide information on the order of magnitude for one illustrative example, the individual cascades have, for example, the following data: the chord of the guide vanes 11 is 125 mm, that of the aerodynamic ribs is approximately 700 mm. The section thickness/chord ratio is 0.1 for the guide vanes and for the aerodynamic ribs.

The conditions for the flow onto the guide vanes 11 are approximately the same as those for leaving the outlet rotor blades 12, i.e. a velocity of c and an angle $\alpha$ of 60°. The guide vanes 11 are now set at an angle $\beta$ in such a way that they operate in the insensitive range. For the pitch/chord ratio of 0.5 selected, this range is 20°. The exhaust gases therefore leave the guide cascade at an angle of approximately 40°, at which they meet the leading edges of the aerodynamic ribs 8, which are also insensitive to oblique incident flow. They are there straightened into the axial direction, i.e. to 0°.

The flow is not only deflected in the guide vanes. It may be seen from the magnitude of the velocity vectors shown at the inlet and outlet of the guide vanes that an additional compression process takes place.

Curve C in FIG. 2 shows the effect of guide vanes with optimum setting for each condition. Up to the $c_t/c_n$ ratio of approximately 1, already mentioned, the pressure recovery is almost constant and only subsequently drops to a modest extent, as compared with the diffuser configuration without guide vanes.

Curve D in the diagram in FIG. 2 also shows the case, not described, where the aerodynamic ribs are designed to have a pitch/chord ratio of 1. This means that for the same chord length, the number of aerodynamic ribs is reduced to half compared with the case described. The ribs could be provided with a correspondingly thick aerofoil section in such a case so that they can better deal with their straightening duty. Because with fewer ribs, there is also less wetted surface in the diffuser to cause frictional loss, the pressure recovery is slightly higher at full load, i.e. with axial outlet flow from the blading, than it is in the case described. As the flow onto the aerodynamic ribs becomes more oblique, however, the pressure recovery necessarily falls rather more steeply than it does with the larger number of ribs.

It is obvious that the pitch/chord ratio is optimized in practice with respect to the importance of the part load with which the machine is operated.

It may also be seen from the diagram that at full load, i.e. in the range of $c_t/c_n$ between −0.1 and +0.1 (depending on the design of the blading), the diffuser configurations corresponding to the state of the art achieve a somewhat better pressure recovery. This is because the surface in the diffuser over which the medium flows is smaller in total than it is in the case of guide vanes.

On the basis of the previous considerations, it follows that at full load of the machine, the mean camber lines of the guide vanes 11 are, on the average, axially directed.

The new measure, however, now also makes it possible to permit a certain reverse swirl at the outlet from the last rotor blades 12 because axial straightening takes place downstream in the diffuser due to the guide vanes and the aerodynamic ribs. This reverse swirl has the following advantages:

the stage work can be increased at the same efficiency; or the efficiency can be increased at the same stage work;

the blades of the last rotor row could be designed to have less twist, which makes them cheaper;

the deflection in the last turbine stage can be reduced which, because of the particle separation, is important—particularly in the case of fluidized bed fired gas turbines.

The invention is obviously not limited to the illustrative example shown and described, whose subject matter is a diffuser with axial outlet, thus greatly facilitating the arrangement of the aerodynamic ribs. It is, in particular, also applicable in the case of steam turbines or the turbines of exhaust gas turbochargers, both of which—generally speaking—have a so-called axial/radial outlet from the blading. The means for swirl removal are represented by the radial part of the outlet casing itself in such machines.

In addition, two or more guide cascades in series are also conceivable where particularly high demands are made with respect to efficiency in the part-load range.

Finally, as a departure from the example shown and described, the camber shape of the guide vanes can also be curved. This would, of course, lead to a substantial increase in the cost of this additional measure.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. Axial flow turbine comprising:

a plurality of rotor blades include a set of outlet rotor blades from which a swirling gas flow may be discharged, a diffuser following said outlet rotor blades in a gas flow direction, means for swirl removal from the swirling flow, said swirl removal means being provided with a retardation zone of the diffuser, and at least one row of adjustable guide vanes arranged between the means for swirl removal and the outlet rotor blades.

2. Axial flow turbine as claimed in claim 1, wherein the guide vanes have a straight mean camber line with a symmetrical aerofoil section.

3. Axial flow turbine as claimed in claim 2, wherein the guide vanes are conically shaped in the radial direction.

4. Axial flow turbine as claimed in claim 2, wherein the guide vanes are twisted.

5. Axial flow turbine as claimed in claim 1, wherein the pitch/chord ratio of the guide vanes is between 0.5 and 1 in the center section of the flow duct.

6. Axial flow turbine as claimed in claim 1, wherein the means for swirl removal within the diffuser are aerodynamic ribs which are arranged evenly around the periphery and which have a straight mean camber line, a symmetrical aerofoil section and a pitch/chord ratio between 0.5 and 1 in the center section of the flow duct.

7. Axial flow turbine as claimed in claim 6, wherein the aerodynamic ribs are conically shaped in the radial direction.

8. Method of operating an axial flow turbine as claimed in claim 1, wherein the guide vanes are adjusted as a function of operating parameters in such a way that the shaft power assumes the maximum possible value at each operating condition.

9. Method of operating an axial flow turbine as claimed in claim 1, wherein the guide vanes are adjusted as a function of operating parameters in such a way that the pressure between the outlet rotor blades and the guide vanes assumes the lowest possible value at each operating condition.

* * * * *